US005204159A

United States Patent [19]

Tan

[11] Patent Number: 5,204,159

[45] Date of Patent: Apr. 20, 1993

[54] DEFORMABLE, SLIP-FREE, ANTI-SKID PADS FOR SNOW AND ICE

[76] Inventor: Domingo K. L. Tan, 6028 Bitternut Dr., Alexandria, Va. 22310

[21] Appl. No.: 677,431

[22] Filed: Mar. 29, 1991

[51] Int. Cl.[5] ..... E01C 11/24; E01C 15/00; B32B 3/30

[52] U.S. Cl. ..... 428/143; 428/99; 428/119; 428/147; 428/149; 428/150; 428/156; 428/172; 428/44; 428/413; 428/423.1; 428/473.5; 428/480; 428/492; 404/19; 404/20; 404/32; 404/33; 404/35; 404/36; 238/14

[58] Field of Search ..... 428/99, 143, 119, 147, 428/149, 150, 156, 172, 44, 413, 423.1, 473.5, 480, 492; 404/19, 20, 32, 33, 35, 36; 238/14; 15/215, 238; 4/581, 582, 583

[56] References Cited

U.S. PATENT DOCUMENTS

| | | | |
|---|---|---|---|
| 127,502 | 6/1872 | Moffet | 404/32 |
| 2,044,407 | 6/1936 | Smith | 428/99 |
| 2,165,955 | 7/1939 | Haarhoff | 404/32 |
| 2,585,515 | 2/1952 | Talboys | 428/99 |
| 3,335,645 | 8/1967 | Eisenberg | 238/14 |
| 4,223,835 | 9/1980 | Witt et al. | 328/14 |
| 4,336,293 | 6/1982 | Eiden | 428/143 |
| 4,340,633 | 7/1982 | Robbins, Jr. | 428/99 |
| 4,348,447 | 9/1982 | Miller, Jr. et al. | 428/143 |
| 4,840,309 | 6/1989 | Teresi | 238/14 |
| 4,998,670 | 3/1991 | Peterson | 238/14 |

*Primary Examiner*—Donald J. Loney
*Assistant Examiner*—William P. Watkins, III
*Attorney, Agent, or Firm*—Jerome J. Norris

[57] ABSTRACT

A deformable slip-free, anti-skid pad comprising: a bottom surface having a plurality of spikes slightly extending vertically from recessed areas of the bottom surface; and a top surface comprising a resilient material having imbedded therein particles of abrasive materials.

10 Claims, 1 Drawing Sheet

DEFORMABLE, SLIP-FREE, ANTI-SKID PADS FOR SNOW AND ICE

FIELD OF THE INVENTION

The present invention generally pertains to pads for placement to form walking spots along a slippery pathway for purposes of preventing slipping when the walker is only wearing ordinary or non-inclement weather types of shoes or footwear.

In particular, the invention is directed to deformable anti-skid pads for placement on slippery surfaces to form slip-free walking spots when walkers step thereon; said pads comprising: anti-skid bottom surfaces having a plurality of spikes slightly extending vertically from flat or hemispherically recessed areas of said bottom surfaces, and top surfaces comprising a resilient material that is flat or a resilient material having imbedded therein particles of abrasive materials held in spaced-apart relationship, wherein some of said abrasive materials extend out of and above an uppermost area of said top surface to provide good friction or slip-free characteristics.

BACKGROUND OF THE INVENTION

It is known to provide anti-skid attachments for shoes or overshoes to prevent slipping and falling when walking on ice, snow or other slippery surfaces, and U.S. Pat. Nos. 2,061,962 and 3,170,251 are exemplary of prior art depicting anti-skid attachments for shoes or overshoes.

However, these anti-skid attachments are expensive and time consuming alternatives when one is desirous of: (1) avoiding shovelling snow from a walkway; or (2) avoiding spreading sand or salt onto a snow laden walkway or pathway to prevent slipping and falling after accumulated snow not timely shovelled has turned to ice.

While shovelling, sanding and salting are physically taxing and time consuming, the alternatives to these steps are oftentimes inconvenient in that they either require removal of ordinary shoes or footwear in order to place inclement weather footwear on or in order to place expensive special attachments onto ordinary footwear that can only be used for the immediate benefit of one wearer, rather than for the use of many walkers travelling across snowy or icy surfaces.

Accordingly, a need exist for efficient means to allow many walkers to cross upon snowy or icy surfaces without slipping, and without having to replace ordinary footwear with inclement weather footwear or add inclement weather boots, slippers, goulashes or anti-skid attachments over ordinary footwear, when it is desirable to avoid shovelling, sanding or salting pathways during snowy weather.

SUMMARY OF THE INVENTION

It is an object of the invention to provide deformable, slip-free, anti-skid pads for placement in walking area to allow many walkers to traverse these areas without falling or slipping when ice or snow is on the ground or when the ground surface is otherwise slippery for other reasons.

A further object of the invention is to provide deformable, slip-free, anti-skid pads that permit a walker to avoid having to remove non-inclement weather footwear and replace it with boots, goulashes, rubbers or other types of inclement weather footwear, in order to walk without falling or slipping when snowy, icy or other types of slippery surfaces or conditions exist on the ground.

DETAILED DESCRIPTION OF THE INVENTION

Figure 1:
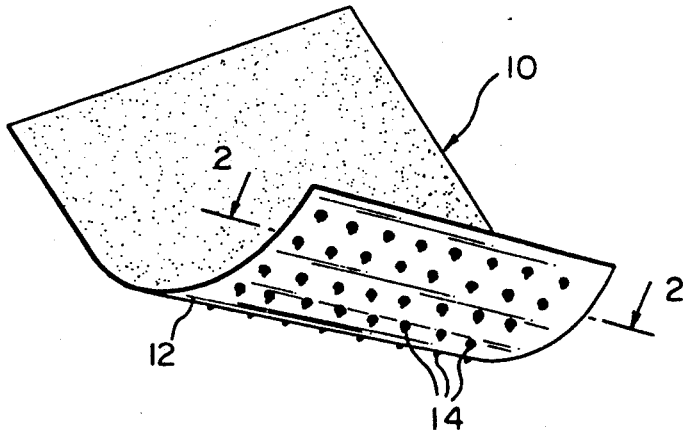
FIG. 1 is a perspective view showing a rectangular configuration of the deformable, slip-free anti-skid pad.
Figure 2:
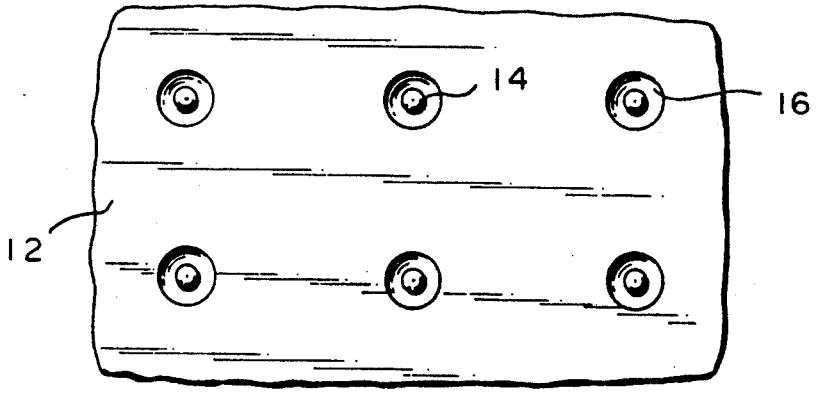
FIG. 2 is a bottom sectional view of the pad of FIG. 1.

The deformable pad 10, as depicted in FIG. 1, prevents falling or slipping during icy, snowy or other types of hazardous surface conditions, and is designed to comprise a bottom surface 12 having a plurality of spikes 14 slightly extending vertically from flat or hemispherically recessed areas 16, wherein said spikes and said recessed areas are made integral with bottom surface 12.

In operation, the placement of the pad upon an icy surface permits the spikes to catch in the ice, and the weight of a walker stepping on the pad causes the spike to sink in further to a point where the bottom surface 12*a* of the hemispheric recessed area is forced directly into contact with the ice. This contact creates a partial vacuum in the spaces in the hemisphere, and provides two mutually reinforcing sources of anti-skid prevention means; namely, spike sources and suction sources.

Figure 3:
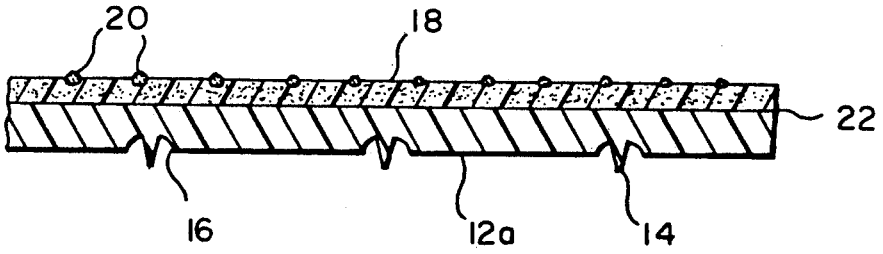
FIG. 3 is a view of a section taken along lines 2—2 of FIG. 1.
Figure 4:
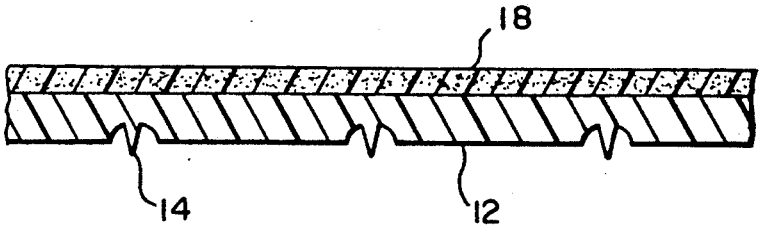
FIG. 4 is an alternative embodiment of FIG. 3, without particles of abrasives imbedded in the top surface.

As can best be seen from FIGS. 3 and 4, the top surface 18 of the deformable pad comprises a resilient material which may be flat or which can have imbedded therein, particles of abrasives 20, which can be non-friable and which extend partially out of an above the uppermost area of the top surface.

Even though the bottom surface of the pad is provided with two mutually reinforcing anti-skid means which will firmly anchor the pad in icy conditions, this alone does not ensure that a walker using ordinary or non-inclement weather footwear will not slip when stepping upon the pad. For example, if the pad is wet or contains small particles of ice or snow, the anchored pad could provide a firm base for an upper slippery surface, against which a walker might slip.

However, either the anti-slip top surface or said anti-slip abrasive particles imbedded and partially extending from an uppermost area of the top surface prevents such a contingency.

The top and bottom surfaces of the deformable, slip-free, anti-skid pads can be made of the same materials or different materials, as long as these materials are resilient and capable of being conformable to the contours of the surfaces upon which they are placed. Further, the top and bottom surfaces may be integral, i.e. made or molded from one single piece. Alternatively, the top and bottom surfaces may be made of different resilient materials, and held together at interface 22 with an adhesive or bonding agent disposed between the bottom and top surfaces.

Any plastic or resinous material may be used to form the top and bottom surfaces of the pad; however, preferred materials are polyester, polyurethanes, epoxy resins, polyimides and natural or synthetic rubbers.

The abrasive materials may be a mixture of sand and vulvanizable rubber. If it is desired that the abrasive materials themselves be anti-abrasive, the abrasive materials may be chosen from: diamond dust, boron carbide, boron nitride, tungsten carbide, alumina ceramic and taconite.

The forms of the invention shown and described herein have been set forth by way of illustration only and are not depicted by way of limitation, and it will be apparent to those skilled in the art that numerous modifications may be made therein without departing from the spirit of the invention or the scope of the appended claims.

I claim:

1. A deformable pad for placement on slippery snow and icy surfaces to form a slip-free walking spot when walkers step thereon, comprising:

a) an anti-skid bottom surface having a plurality of spikes slightly extending vertically from hemispherically recessed areas of said bottom surface; and b) an anti-slip top surface comprising a resilient material having embedded therein particles of abrasive materials held in spaced-apart relationship, and wherein said abrasive materials extend partially out of and above an uppermost area of said top surface.

2. The pad of claim 1, wherein an adhesive or bonding agent is disposed between an interface between said bottom surface and said top surface.

3. The pad of claim 1, wherein said bottom surface and said top surface are formed from materials selected from the group consisting of a polyester, a polyurethane, epoxy resins, polyimides and natural and synthetic rubbers.

4. The pad of claim 3, wherein said abrasive materials are mixtures of sand and vulcanizable rubbers.

5. The pad of claim 3, wherein said abrasive materials are nonfriable particles selected from the group consisting of diamond dust, boron carbide, boron nitride, tungsten carbide, aluminum ceramic and taconite.

6. The pad of claim 3, wherein said bottom surface and said top surface are integral and formed of one material.

7. A plurality of pads of claim 1, placed to form a walkway on a slippery surface.

8. A plurality of pads of claim 7, wherein the surface is ice.

9. A plurality of pads of claim 7, wherein the surface is snow.

10. A plurality of pads of claim 7, wherein the surface is a mixture of ice and snow.

* * * * *